US006346925B1

(12) United States Patent
Matsumoto

(10) Patent No.: US 6,346,925 B1
(45) Date of Patent: Feb. 12, 2002

(54) ANTENNA AND PORTABLE TERMINAL APPARATUS

(75) Inventor: Hiroyuki Matsumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/524,910

(22) Filed: Mar. 14, 2000

(30) Foreign Application Priority Data

Mar. 15, 1999 (JP) ..... 11-068758

(51) Int. Cl.[7] ..... H01Q 1/24

(52) U.S. Cl. ..... 343/895; 343/702
(58) Field of Search ..... 343/702, 700 MS, 343/895, 906, 900; 455/90

(56) References Cited

U.S. PATENT DOCUMENTS 6,052,088 A * 4/2000 Simmons et al. ..... 343/702
6,150,984 A * 11/2000 Suguro et al. ..... 343/702

* cited by examiner

*Primary Examiner*—Don Wong
*Assistant Examiner*—James Clinger
(74) *Attorney, Agent, or Firm*—Jay H. Maioli

(57) ABSTRACT

Antenna and portable terminal apparatus capable of decreasing the area of installing an antenna on a base board and reducing the influence by an approach of a human body, includes a helical antenna from a feeding point of a quarter wave antenna to the portion of one-eighth wavelength and a bent antenna from the portion of one-eighth wavelength to an open end, thereby decreasing the area for installing the antenna on the base board and reducing the influence by the approach of a human body.

12 Claims, 7 Drawing Sheets

ANTENNA AND PORTABLE TERMINAL APPARATUS

BACKGROUND OF THE INVENTION

1. Field of the Invention

The present invention relates to an antenna and portable terminal apparatus suitable for use in, for example, a cellular phone.

2. Description of the Related Art

A cellular phone is provided with a whip antenna that can be extended from a box-shaped body during use and can be accommodated in the box-shaped body at non-use, and an internal antenna for exclusive use of receiving. As the whip antenna, a monopole antenna has been used, and as the internal antenna, an inverted-F antenna has been used. The inverted-F antenna can be integrated into the box-shaped body by bending a plate-shaped monopole antenna parallel to the bottom board (earth plate).

FIG. 10 is a view showing the structure of the conventional internal antenna. A helical antenna 103 shown in FIG. 10 is viewed from the side of the lower case 100 (the opposite side to the contact side with a human body). In FIG. 10, most portions on a base board 101 are covered with a shield case 102, and on the upper portion of the base board 101 that is not covered with the shield case 102, the helical antenna 103 is horizontally positioned with its feeding point and open end portion fixed on the base board 101.

The above-mentioned conventional whip antenna, however, uses the box-shaped body as the bottom board; accordingly, it is disadvantageously affected by a peripheral mounted thereon. The inverted-F antenna disadvantageously occupies a large space of the box-shaped body because of being a plate shape. In the conventional internal antenna as shown in FIG. 10, the helical antenna 103 is horizontally positioned on the base board 101; therefore, it occupies a larger area for installation on the base board, while decreasing the area for installation of the other components on the base board. Further, since the helical antenna 103 is horizontally positioned on the base board 101 and the open end portion is fixed on the base board, in the conventional antenna, it is impossible to use the back side of the base board, thereby to lose a space for placing the bottom board between the open end portion and a human body. Therefore, it is easily affected by a human body disadvantageously.

In the case of using a chip antenna such as a microstrip antenna as an internal antenna, it occupies a reduced amount of space because of being miniaturized. However, since the whole chip is mounted on the base board, hence to decrease the space for installation of the other components on the base board, it is also impossible to place the bottom board between the open end portion and a human body. Therefore it is easily affected by a human body disadvantageously.

SUMMARY OF THE INVENTION

It is an object of the present invention to provide an antenna and portable terminal apparatus that occupies a reduced amount of space for its installation on a base board and that is not affected much by an approach of a human body, by using a helical antenna from a feeding point of a quarter wave antenna to a portion of one-eighth wavelength and a bent antenna from the portion of one-eighth wavelength to an open end portion.

An antenna according to the present invention comprises a helical antenna portion having one end connected to a feeding point of said antenna apparatus and having a length corresponding to substantially half of an electrical wave length of said antenna apparatus, and an extended antenna portion having one end connected to the other end of said helical antenna portion and having a length corresponding to substantially half of an electrical wave length of said antenna apparatus, said extended antenna portion being bent at least at one portion.

A portable terminal apparatus according to the present invention comprises a helical antenna portion having one end connected to a feeding point of said antenna apparatus and having a length corresponding to substantially half of an electrical wave length of said antenna apparatus, and an extended antenna portion having one end connected to the other end of said helical antenna portion and having a length corresponding to substantially half of an electrical wave length of said antenna apparatus, said extended antenna portion being bent at least at one portion.

BRIEF DESCRIPTION OF THE DRAWINGS

FIG. 3 is a lateral view showing the structure of the portable terminal apparatus according to the embodiment.

FIG. 8 is a view showing a mountable portion on a base board in the embodiment.

DETAILED DESCRIPTION OF THE PREFERRED EMBODIMENT

An antenna and portable terminal apparatus of the present embodiment is to reduce the area of its installation on a base board and also reduce influence from an approach of a human body, by using a helical antenna from a feeding point of a quarter wave antenna to a portion of one-eighth wavelength and a bent antenna from the portion of one-eighth wavelength to an open end portion.

Figure 1:
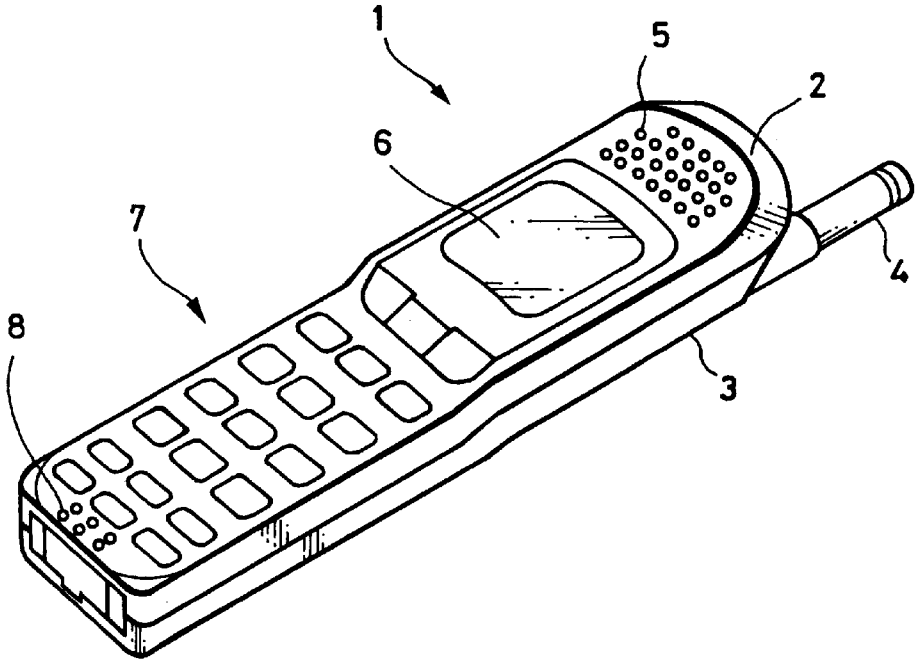
FIG. 1 is a perspective appearance view of a portable terminal apparatus according to the embodiment.

FIG. 1 is a perspective appearance view of a portable terminal apparatus according to the embodiment. In FIG. 1, the portable terminal apparatus 1 is formed by an upper case 2 and a lower case 3 engaged with each other. The upper case 2 is provided with a speaker 5 for supplying a received sound, on the upper portion, a display unit 6 for displaying telephone numbers and the like, on the middle portion, and an input key 7 allowing entry of telephone numbers and the like and a microphone 8 allowing communication through voice input, on the lower portion. The lower case 3 is provided with a whip antenna 4 on the upper portion.

Figure 2:
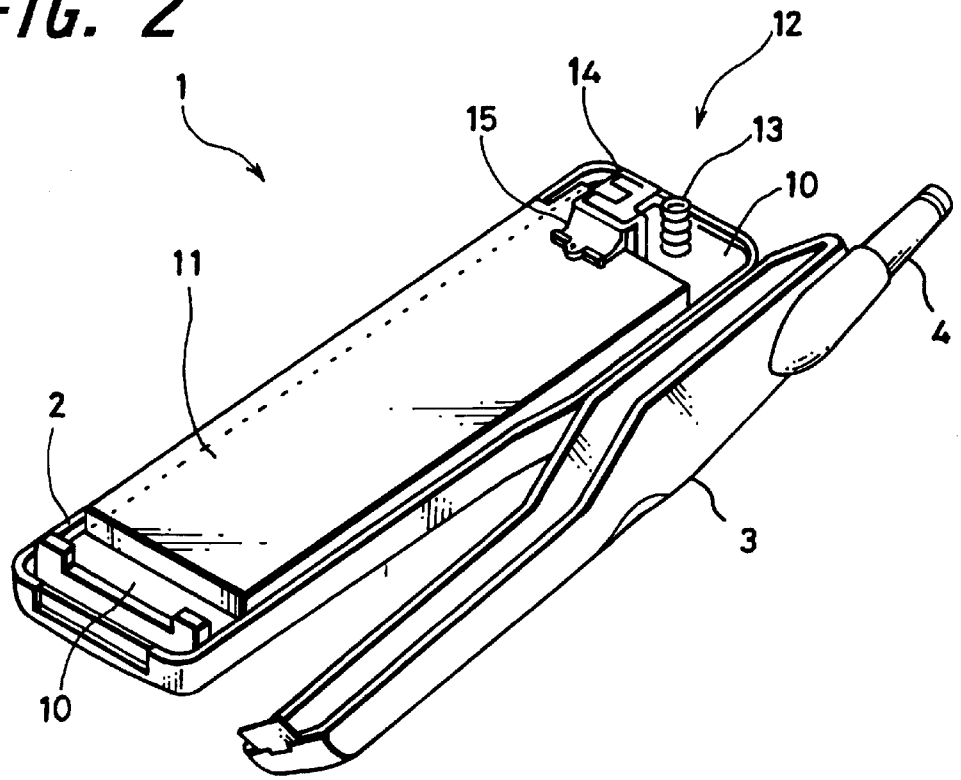
FIG. 2 is an exploded perspective view showing the internal structure of the portable terminal apparatus according to the embodiment.

FIG. 2 is an exploded perspective view showing the internal structure of the portable terminal apparatus according to the embodiment. In FIG. 2, when the lower case 3 is removed with the upper case 2 put downward, in the portable terminal apparatus 1, disposed is a base board 10 with predetermined circuitry for communication arranged inside the upper case 2. The surface excepting the upper and lower portion of the base board 10 is covered with a shield case 11 having the earth coat applied there for covering the electric circuitry.

An internal antenna 12 is provided in the upper portion exposed out of the shield case 11 on the base board 10. The internal antenna 12 is formed by a helical antenna 13 and a bent antenna 14. The helical antenna 13 is vertically provided on the base board, and the top of the helical antenna 13 is connected to the bent antenna 14. The bent antenna 14 is supported by a support 15 at a distance from the base board 10.

Figure 3A:
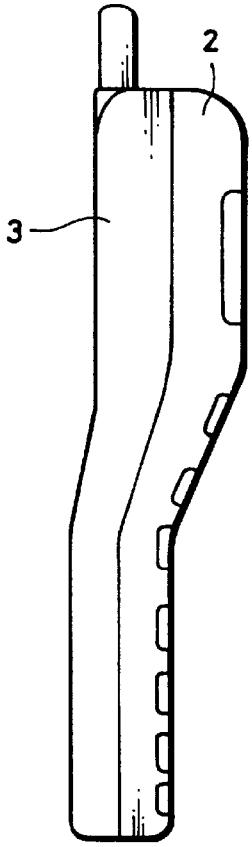
FIG. 3A shows the appearance thereof and FIG. 3B shows the inside thereof.
Figure 3B:
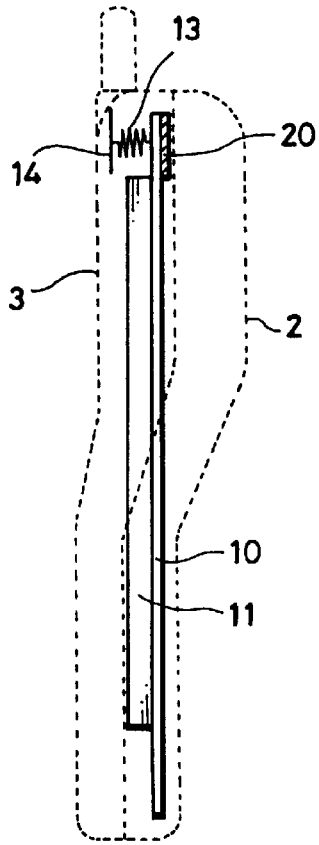

FIG. 3 is a lateral view showing the structure of the portable terminal apparatus according to the embodiment. FIG. 3A shows the appearance thereof, and FIG. 3B shows the inside thereof. The helical antenna 13 shown in FIG. 3B stands vertically to the base board, in the upper portion exposed out of the shield case 11 on the base board 10 in the lower case 3, in FIG. 3A. The top of the helical antenna 13 is continuously connected to the bent antenna 14. The surface of the helical antenna 14 is at a predetermined distance from the base board surface. An earth plate 20 is positioned at the opposite side of the base board 10 to the bent antenna 14, in the upper case 2. The earth plate 20 works to combine the electric field produced at the open end portion of the bent antenna 14 before a human body, thereby reducing the influence from the human body.

Figure 4:
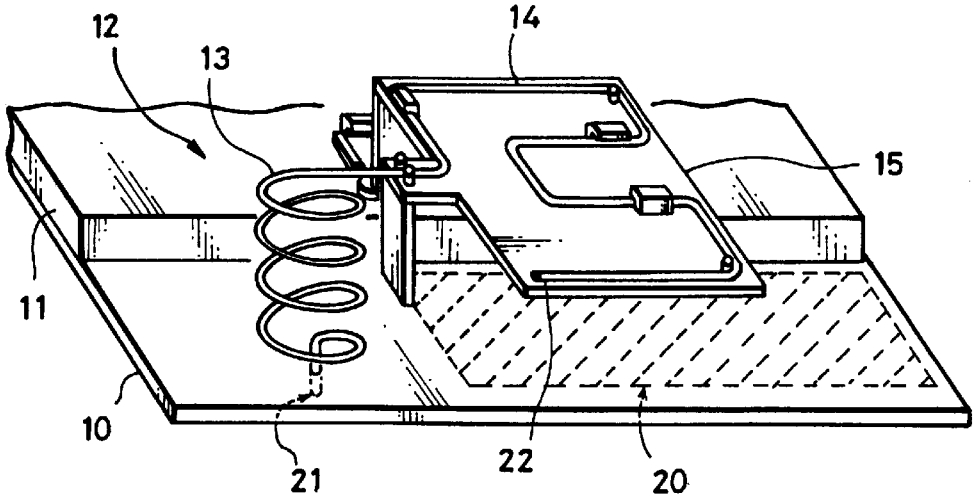
FIG. 4 is a partly enlarged perspective view showing the structure of an antenna according to the embodiment.

FIG. 4 is a partly enlarged perspective view showing the structure of an antenna according to the embodiment. In FIG. 4, the helical antenna 13 stands at right angle to the base board surface from a feeding point 21 on the base board in the bottom toward the top, in the base board end portion exposed out of the shield case 11 on the base board 10.

The top of the helical antenna 13 is continuously connected to a first linear portion of the bent antenna 14 in the width direction of the base board (on the right side), and the first linear portion of the bent antenna 14 is bent at a first curve toward the center of the base board (toward the side of the shield case 11) to be continued to a second linear portion. Further, it is bent at a second curve toward the width direction of the base board (on the right side) to be continued to a third linear portion. It is further bent at a third curve toward the distal end portion of the base board to be continued to a fourth linear portion. Further, it is bent at a fourth curve toward the width direction of the base board (on the left side) to be continued to a fifth linear portion.

Further, the fifth linear portion in the width direction of the base board (on the left side) of the bent antenna 14 is bent toward the distal end portion of the base board to be continued to a sixth linear portion, it is bent at a sixth curve toward the width direction of the base board (on the right side) to be continued to a seventh linear portion, it is bent at a seventh curve toward the distal end portion of the base board to be continued to an eighth linear portion, and it is further bent at an eighth curve toward the width direction of the base board (on the left side) to be continued to a ninth linear portion.

In these first to ninth linear portions and first to eighth curves, each direction and length is supported by the support 15 provided on the surface of the base board 10 and the shield case 11. The support 15 provides a predetermined space between the plane formed by the bent antenna 14 and the base board surface. On the opposite side to the plane formed by the bent antenna 14, an earth plate 20 is provided on the back side of the base board covering an open end 22 of the bent antenna 14. The earth plate 20 combines the electric field produced at the open end portion of the bent antenna 14 before a human body, thereby reducing the influence from the human body.

This time, the operation of an antenna according to the embodiment will be described.

Figure 5:
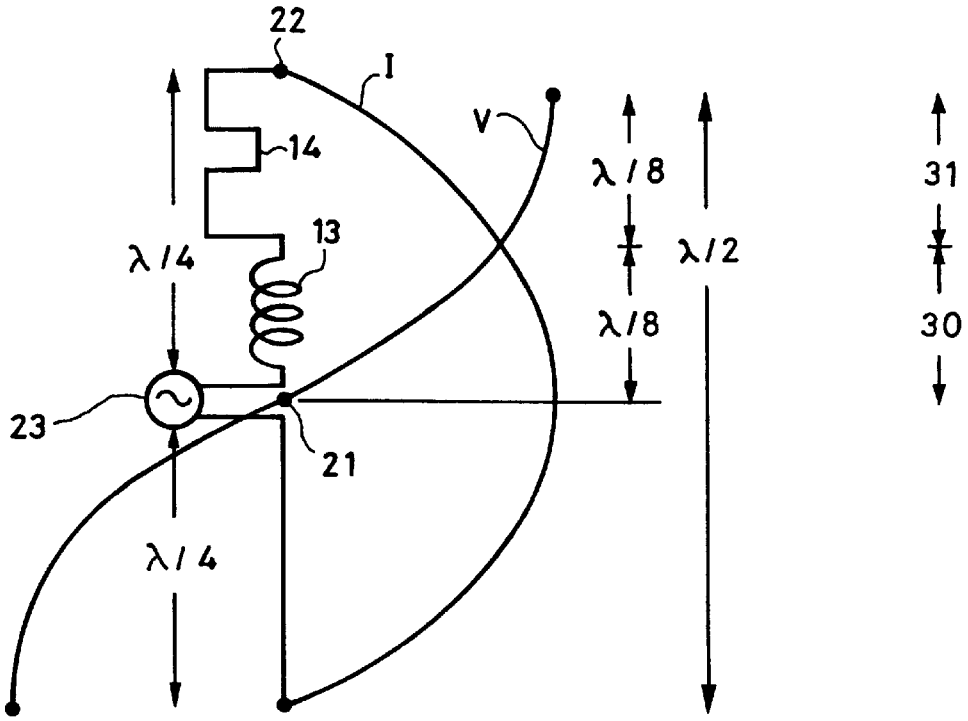
FIG. 5 is a view showing the operation of the antenna according to the embodiment.

FIG. 5 is a view showing the operation of the antenna according to the embodiment. An antenna 12 formed by the helical antenna 13 and the bent antenna 14 according to the embodiment is a quarter wave (λ) antenna.

In FIG. 5, the current I and the voltage V of a predetermined sine waveform or cosine waveform are supplied to one end of the helical antenna 13 from the feeding unit 23 at the feeding point 21. The helical antenna 13 is provided in the portion from the feeding point 21 to the portion of one-eighth wavelength (λ), and the bent antenna 14 is provided in the portion from the portion of one-eighth wavelength (λ) to the open end 22.

In the case of considering a dipole antenna of half wavelength (λ) in which a quarter wavelength (λ) of the antenna 12 consisting of the helical antenna 13 and the bent antenna 14 according to the embodiment is folded back to the feeding point 21, the current I and the voltage V produced in the antenna are as shown in FIG. 5. When largeness is shown in the horizontal direction with the antenna shown in the vertical direction, the current I becomes zero at the both end portions of the dipole antenna, and it becomes the maximum plus at the feeding point 21, while the voltage V becomes the maximum minus or maximum plus at the both end portions of the dipole antenna, and it becomes zero at the feeding point 21.

Therefore, in the quarter wavelength (λ) of the antenna 12 consisting of the helical antenna 13 and the bent antenna 14 according to the embodiment, the portion corresponding to the helical antenna 13 from the feeding point 21 to the portion of one-eighth wavelength (λ) becomes the current dominant area 30 because the value of the current I operates extremely, and the portion corresponding to the bent antenna 14 from the portion of one-eighth wavelength (λ) to the open end 22 becomes the electric charge (voltage) dominant area 31 because the value of the voltage V operates extremely.

As mentioned above, in the antenna according to the embodiment, the portion near to the feeding point 21 becomes the current dominant area and the portion near to the open end 22 becomes the electric charge dominant area, on the boundary of the portion of one-eighth wavelength (λ). Therefore, when a human body approaches the electric charge (voltage) dominant area on the side near to the open end from the portion of one-eighth wavelength (λ), an input impedance of the antenna is apt to be affected much by the human body because the disturbance of electric field occurs due to the electric charge being a great value there. However, even if a human body approaches the current dominant area on the side near to the feeding point from the portion of one-eighth wavelength (λ), an input impedance is not much affected by the human body. Therefore, the bent antenna corresponding to the electric charge (voltage) dominant area should be arranged in an effective area distant from a human body as far as possible, thereby to decrease the area for installing an antenna on the base board and reduce the influence by an approach of a human body.

Figure 6:
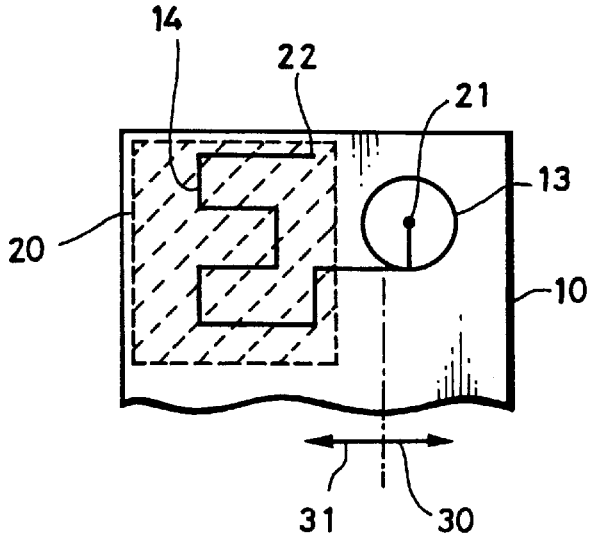
FIG. 6 is a view showing the operation of the antenna on a base board according to the embodiment.
Figure 7:
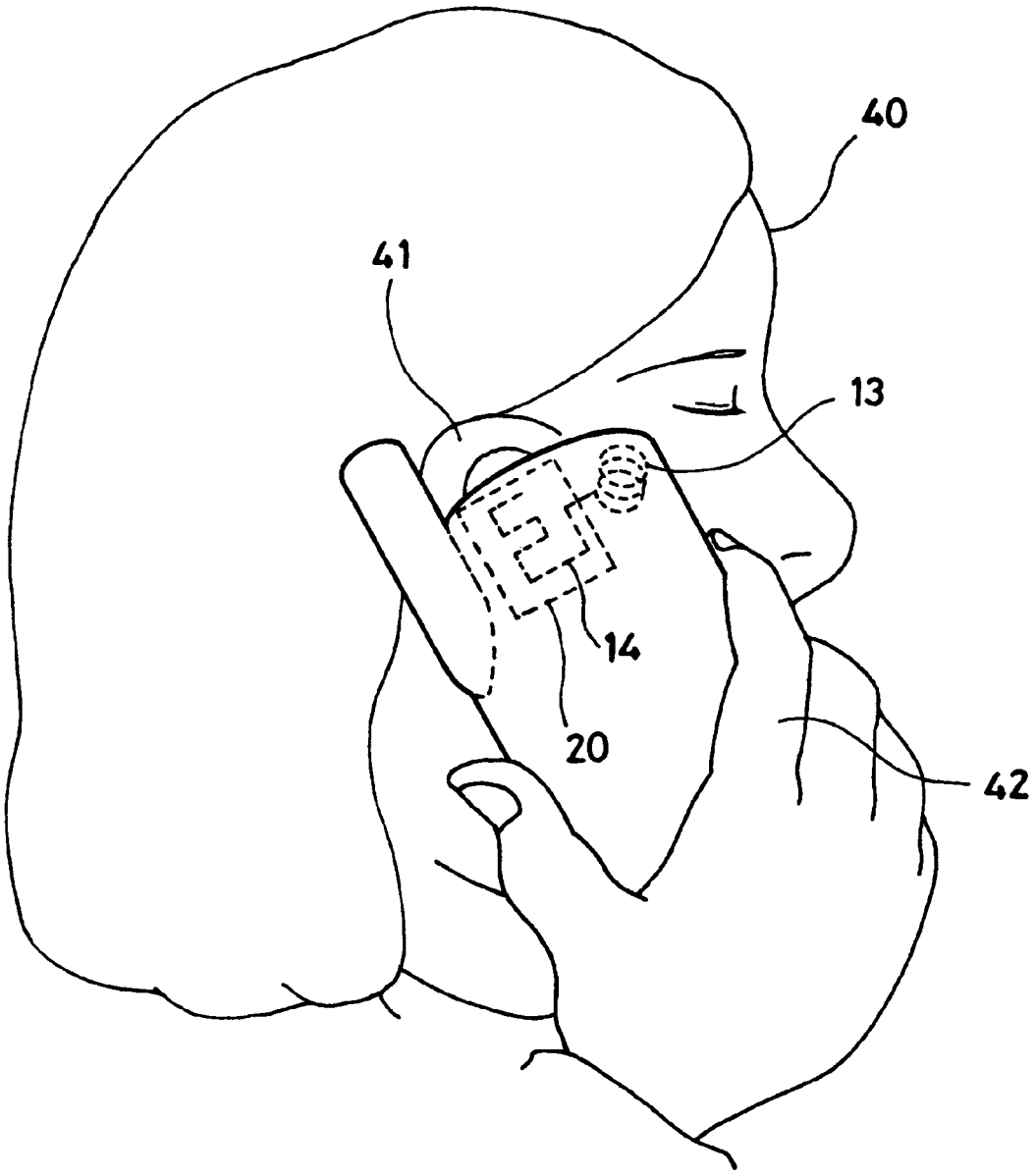
FIG. 7 is a view showing the using state of the embodiment.

FIG. 6 is a view showing the operation of the antenna on the base board according to the embodiment. FIG. 7 is a view showing the using state of the embodiment. In FIG. 6, the portion corresponding to the helical antenna 13 disposed on the base board 10 from the feeding point 21 to the portion of one-eighth wavelength (λ) becomes the current dominant area 30 because the value of the current I operates extremely, and the portion corresponding to the bent antenna 14 from the portion of one-eighth wavelength (λ) to the open end 22 becomes the electric charge (voltage) dominant area 31 because the value of the voltage V operates extremely. The earth plate 20 is positioned on the back surface of the base board 10, so as to cover the open end 22 on the opposite side to the bent antenna 14.

As mentioned above, the portion near to the feeding point 21 becomes the current I dominant area and the portion near to the open end 22 becomes the electric charge dominant area, on the boundary of the portion of one-eighth wavelength (λ). When a human body approaches the electric charge (voltage) dominant area 31 on the side near to the open end 22 from the portion of one-eighth wavelength (λ), an input impedance is apt to be affected much caused by the disturbance of electric field due to a large value of the electric charge. If a human body approaches the current dominant area 30 on the side near to the feeding point 21 from the portion of one-eighth wavelength (λ), an input impedance is not much affected.

As shown in the using state in FIG. 7, the bent antenna 14 corresponding to the electric charge (voltage) dominant area 31 is positioned on the top surface of the base board 10 toward the side of the lower case 3 so as to have a good distance from a human body 40, and further positioned on the left side out of contact with a finger 42. As shown in FIG. 7, the apparatus is used in a manner of holding it with the fingers 42 put along on the portion below the helical coil 13 on the side of the lower case 3 in many cases.

Further, the earth plate 20 is provided on the base board 10 on the side of the upper case 2 between the bent antenna 14 and a speaker 5 on the upper case 2 which often comes into contact with a ear 41 of the human body 40, and the electric field of the electric charge (voltage) dominant area 31 is forcedly combined with the earth plate 20, thereby to make the electric field stable.

FIG. 8 is a view showing the mountable portion of the base board according to the embodiment. FIG. 8A shows the bottom face of the base board viewed from the side of the lower case 3, FIG. 8B shows the mountable portion on the bottom face of the base board, FIG. 8C shows the top face of the base board viewed from the side of the upper case 2, and FIG. 8D shows the mountable portion on the top face of the base board.

Figure 8A:
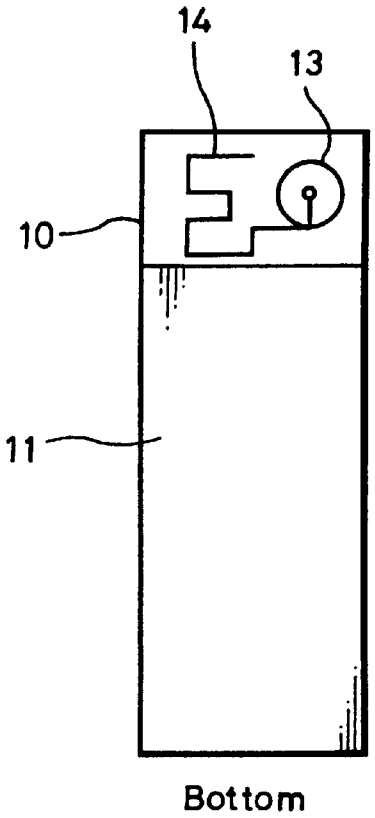
FIG. 8A shows the arrangement of an antenna in the bottom.
Figure 8B:
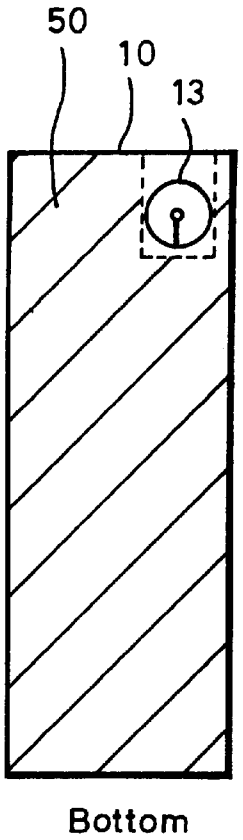
FIG. 8B shows the mountable portion in the bottom.

As shown in FIG. 8A, the helical antenna 13 is positioned vertically to the base board on the right side of the upper end portion exposed out of the shield case 11, on the bottom face of the base board 10, and the bent antenna 14 having predetermined linear portions and bent portions is positioned on the left side, at a given distance from the surface of the base board 10. Therefore, the diagonally shaded area other than the mountable area of the helical antenna 13, as shown in FIG. 8B, is provided as the mountable portion 50 of the other components.

Figure 8C:
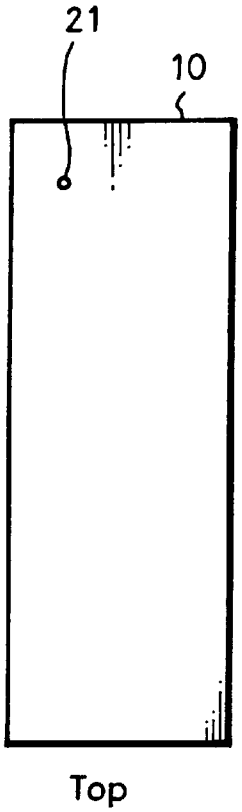
FIG. 8C shows a feeding point in the top.
Figure 8D:
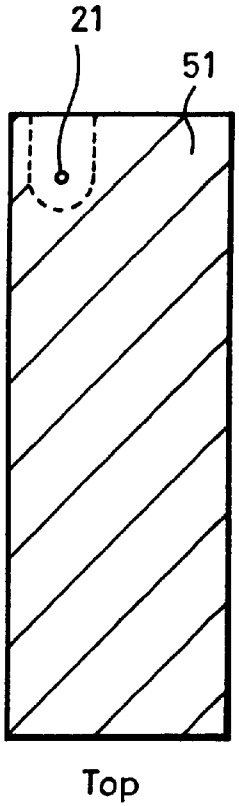
FIG. 8D shows the mountable portion in the top.
Figure 9A:
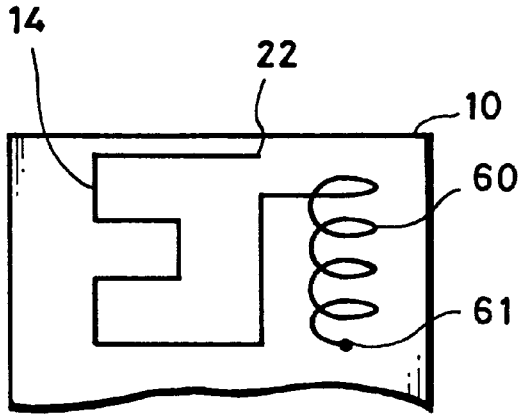
FIG. 9 is a view showing each structure of the other antennas according to the embodiment.
Figure 9B:
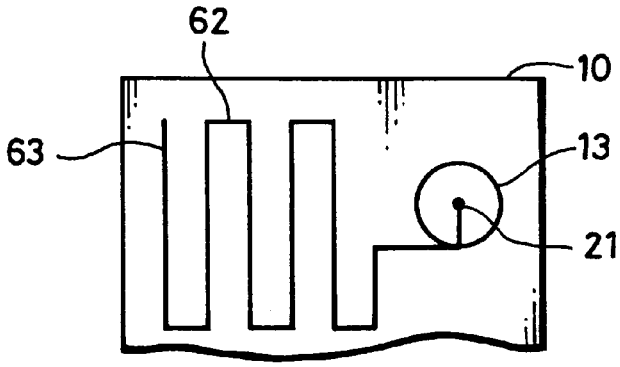
Figure 9C:
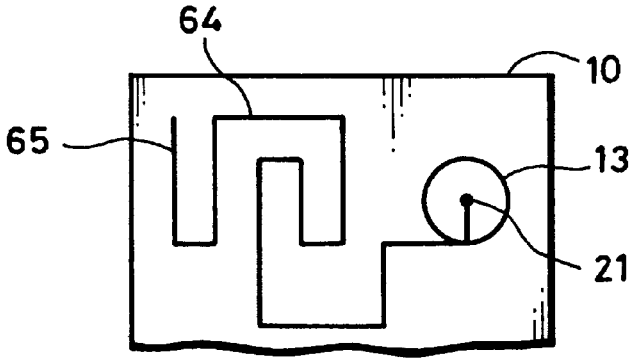
Figure 9D:
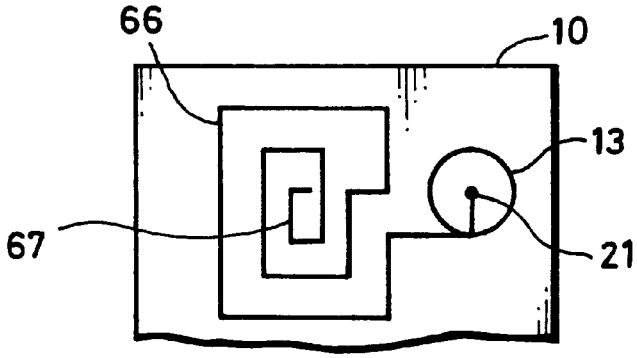
Figure 10:
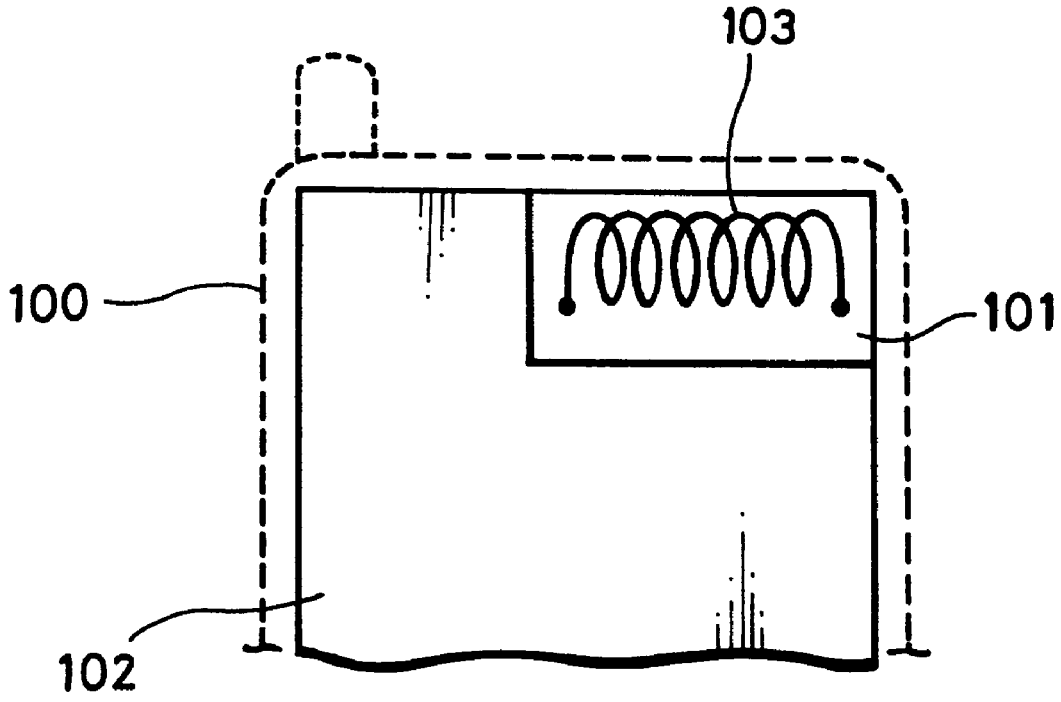
FIG. 10 is a view showing the structure of the conventional antenna.

As shown in FIG. 8C, since only the feeding point 21 is provided on the top face of the base board 10, the diagonally shaded area other than the feeding point 21 as shown in FIG. 8D is provided as the mountable portion 51 of the other components.

As mentioned above, since the antenna according to the embodiment is arranged in that the helical antenna 13 is erected vertically to the base board 10 surface from the feeding point 21 of the bottom to the top and that the surface which an extended antenna forms from the portion of about one-eighth wavelength of the feeding point 21 to the open end 22, continuously to the top of the helical antenna 13, is at a given distance from the base board 10 surface, it can reduce the influence by an approach of a human body. Further, since the portion other than the mountable portion of the helical antenna 13 in the diameter direction, including the opposite surface of the base board to the portion formed by the extended antenna, can be provided as the mountable portion 50 of the other components, it can enlarge the mountable area on one surface of the base board. Since only the feeding point 21 is provided on the other surface of the base board, the portion other than the feeding point 21 can be provided as the mountable portion 51 of the other components, thereby enlarging the mountable area on the other surface of the base board.

As mentioned above, since the extended antenna is the bent antenna 14 having a linear portion and a bent portion never crossing and never contacting, the antenna according to the embodiment can be manufactured at ease, and it can be designed in any structure by locating the open end 22 away from the other components on the base board so as to obtain a predetermined wavelength of quarter λ easily.

The distance from the bottom of the feeding point 21 on the base board 10 to the top of the helical antenna 13 erected vertically is made larger than the height of the support 15, by way of example, and therefore, the bottom of the helical antenna 13 can be elastically fixed to the feeding point 21 when positioning the bent antenna 14 over the base board 10 with the support 15.

As mentioned above, in the antenna according to the embodiment, the bottom of the helical antenna 13 can be elastically fixed to the feeding point 21 on the base board 10 by locating the top of the helical antenna 13 at a given distance from the surface of the base board 10. Therefore, by making larger the distance from the bottom of the feeding point 21 on the base board 10 to the top of the helical antenna 13 erected vertically to the base board 10, the bottom of the helical antenna 13 is elastically fixed to the feeding point 21 when allocating the antenna to the base board 10, thereby being served as a simple connector.

The structure of the helical antenna 13 and the bent antenna 14 is not restricted to the above-mentioned structure, but the structure mentioned below may be used.

FIG. 9 is a view showing each structure of the other antennas according to the embodiment. FIG. 9A shows the structure of a helical antenna 60 longitudinally positioned (in the longitudinal direction of a base board). FIG. 9B shows the structure in which the folded portion of the linear portion of a bent antenna 62 is arranged in the vertical direction. FIG. 9C shows the structure in which the folded portion of the linear portion of a bent antenna 64 is arranged in the lateral direction. FIG. 9D shows the structure in which the folded portion of the linear portion of a bent antenna 66 is arranged in a helical shape.

The structure of the bent antenna 14 is not restricted to the above-mentioned structure, but it may be formed on a plan surface with the support 15, or it may be formed in a cubic way or a curved way. In these ways, the bent antenna 14 can be formed freely by locating the open end 22 far away from the other components on a base board so as to make it easy to get a predetermined wavelength of quarter λ.

As set forth hereinabove, the antenna and portable terminal apparatus of the present invention, in which the electrical length as for the predetermined wavelength is substantially quarter wave, comprises a first antenna unit and a second antenna unit, the first antenna unit being a helical antenna from the feeding point on the base board by the feeding unit to the portion of about one-eighth wavelength, the second antenna unit being an extended antenna having linear portions and curved portions extended from the portion of about one-eighth wavelength to the open end as an extended antenna. The portion near to the feeding point becomes the current dominant area, and the portion near to the open end becomes the electric charge dominant area, on the boundary of one-eighth wavelength (λ). When a human body approaches the electric charge (voltage) dominant area on the side near to the open end from the portion of one-eighth wavelength (λ), the input impedance of the antenna is much affected by the body because the disturbance of the electric field occurs owing to a great value of the electric charge there, while when a human body approaches the current dominant area on the side near to the feeding point from the portion of one-eighth wavelength (λ), the input impedance is not affected much. Therefore, the bent antenna corresponding to the electric charge (voltage) dominant area is located in an effective area distant from the human body as far as possible, thereby making it possible to reduce the area for mounting the antenna on a base board and reduce the influence by an approach of a human body.

Further, as mentioned above, in the antenna of the present invention, the top of the helical antenna is provided to have a given space between the base board surface and itself, and the bottom of the helical antenna is elastically fixed to the feeding point on the base board surface. Therefore, by making larger the distance from the bottom of the feeding point on the base board to the top of the helical antenna erected vertically to the base board, the bottom of the helical antenna can be elastically fixed to the feeding point when allocating the antenna to the base board, thereby being served as a simple connector advantageously.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna apparatus; comprising:

a helical antenna portion having one end connected to a signal feeding point of the antenna apparatus, and an extended antenna portion having one end connected to another end of said helical antenna portion and having at least one bent portion, wherein said extended antenna portion is located in a plane that is substantially perpendicular to a longitudinal axis of said helical antenna portion.

2. The antenna apparatus according to claim 1, further comprising a substrate having a grounding area arranged at a position to act to combine an electric field produced at an open end of said extended antenna portion.

3. The antenna apparatus according to claim 1, further comprising a substrate having a portion for connection to said signal feeding point, and wherein said longitudinal axis of said helical antenna portion is arranged to be substantially perpendicular to said substrate from the feeding point, and said extended antenna portion is spaced apart from said substrate.

4. The antenna apparatus according to claim 3, wherein one end of said helical antenna portion is connected to said substrate by an elastic force of said helical antenna portion.

5. The antenna apparatus according to claim 1, further comprising a substrate having a portion for connecting to said signal feeding point, wherein said one end of said helical antenna portion is connected to said substrate by an elastic force of said helical antenna portion.

6. A portable terminal apparatus having an antenna, comprising;

a helical antenna portion having one end connected to a signal feeding point of said antenna, and an extended antenna portion having one end connected to another end of said helical antenna portion and having at least at one bent portion, wherein said extended antenna portion is located in a plane that is perpendicular to a longitudinal axis of said helical antenna portion.

7. The portable terminal apparatus according to claim 6, further comprising a substrate having a grounding area arranged at a position to act to combine an electric field produced at an open end of said extended antenna portion.

8. The portable terminal apparatus according to claim 6, further comprising a substrate having a portion for connecting to said feeding point, and wherein said longitudinal axis of said helical antenna portion is arranged substantially perpendicular to said substrate from the feeding point, and said extended antenna portion is spaced apart from said substrate.

9. The portable terminal apparatus according to claim 8, wherein one end of said helical antenna portion is connected to said substrate by an elastic force of said helical antenna portion.

10. An antenna apparatus comprising:

a helical antenna portion having one end connected to a signal feeding point of the antenna apparatus, an extended antenna portion having one end connected to another end of said helical antenna portion and having at least one bent portion, and a substrate having a grounding area arranged at a position thereon to act to combine an electric field produced at an open end of said extended antenna portion.

11. An antenna apparatus comprising:

a helical antenna portion having one end connected to a signal feeding point of the antenna apparatus, an extended antenna portion having one end connected to another end of said helical antenna portion and having at least one bent portion, a substrate having a portion for connecting to said signal feeding point, and wherein said one end of said helical antenna portion is connected to said substrate by an elastic force of said helical antenna portion.

12. The antenna apparatus according to claim 11, wherein said substrate includes a grounding portion arranged at a position thereon to act to combine an electric field produced at an open end portion of said extended antenna portion.

* * * * *